US006012598A

United States Patent [19]

Antoniou

[11] Patent Number: 6,012,598

[45] Date of Patent: Jan. 11, 2000

[54] FREIGHT CONTAINER

[75] Inventor: Aris Antoniou, Kingwood, Tex.

[73] Assignee: The Columbiana Boiler Company, Columbiana, Ohio

[21] Appl. No.: 08/871,216

[22] Filed: Jun. 9, 1997

[51] Int. Cl.[7] ..... B65D 90/20

[52] U.S. Cl. ..... 220/1.5; 220/562; 220/668

[58] Field of Search ..... 220/1.5, 562, 592, 220/668, 647, 646, 563, 564, 565

[56] References Cited

U.S. PATENT DOCUMENTS

| | | | |
|---|---|---|---|
| 3,726,431 | 4/1973 | Botkin | 220/1.5 |
| 3,730,384 | 5/1973 | Ramme | 220/562 |
| 3,971,491 | 7/1976 | Mowalt-Larssen et al. . | |
| 4,060,174 | 11/1977 | Gerhard | 220/1.5 |
| 4,065,022 | 12/1977 | Cainaud | 220/1.5 |
| 4,341,737 | 7/1982 | Albano et al. . | |
| 4,403,387 | 9/1983 | Pechacek . | |
| 4,423,022 | 12/1983 | Albano et al. . | |
| 4,445,624 | 5/1984 | Gill | 220/668 |
| 4,461,751 | 7/1984 | Albano et al. . | |
| 4,538,798 | 9/1985 | Pechacek . | |
| 4,673,464 | 6/1987 | Zeitsch . | |
| 4,724,975 | 2/1988 | Leventry . | |
| 4,755,234 | 7/1988 | Suzuki et al. . | |
| 4,790,058 | 12/1988 | Miller . | |
| 4,895,397 | 1/1990 | Miller . | |
| 5,004,275 | 4/1991 | Miller . | |
| 5,066,053 | 11/1991 | Miller . | |
| 5,115,933 | 5/1992 | Gerhard . | |
| 5,390,827 | 2/1995 | Toth et al. | 220/1.5 |
| 5,688,086 | 11/1997 | Menzemer et al. | 220/1.5 |

OTHER PUBLICATIONS

International Standard ISO 1496–3, Series 1 freight containers—Specification and testing—Fourth edition, Mar. in 1995.

International Standard ISO 668, Series 1 freight containers—Classification, dimensions and ratings Fifth edition—Dec. 15, 1995.

1995 ASME Boiler & Pressure Vessel Code VIII Division 1 and Division 2—Alternative Rules (2 volumes).

*Primary Examiner*—Stephen Castellano
*Attorney, Agent, or Firm*—Renner, Otto, Boisselle & Sklar, P.L.L.

[57] ABSTRACT

A freight container for transporting a pressurized fluid at a design pressure P, including a tank and mounted within an ISO frame. The tank includes a vessel formed of a material having an ultimate tensile strength $S_U$. The vessel has a cylindrical shell having an inside radius $R_I$ and a thickness $T_s$ which is less than that of prior art freight containers and substantially equal to: $(P^*R_I)/(\frac{1}{3}S_u-0.5\ P)$. Such a vessel conforms to ASME Boiler and Pressure Vessel Code, Section VIII, Division 2. The freight container may be mounted on a transport vehicle, before or after being filled with the pressurized fluid, and transported to a remote location.

16 Claims, 3 Drawing Sheets

FREIGHT CONTAINER

FIELD OF THE INVENTION

This invention relates generally to a freight container for pressurized fluid commonly known as a tank container.

BACKGROUND AND SUMMARY OF THE INVENTION

Conventionally, a freight container is considered an article of transport equipment having an internal volume of 1 $m^3$ (35.3 $ft^3$) or more. A freight container is intended for repeated use, and it is specifically designed to facilitate the carriage of goods by one or more modes of transportation, without intermediate reloading. A freight container may be fitted with devices permitting its ready handling, such as its transfer from one mode of transport to another. (In the context of the present application, the term "freight container" includes neither vehicles nor conventional packaging.)

An ISO container is a freight container complying with relevant ISO container standards in existence at the time of its manufacture. The ISO is an international standards setting organization, and compliance with its standards is not mandatory. International Standards ISO 668 (5th edition) and ISO 1496-3 (4th edition) are hereby incorporated by reference.

The present application particularly concerns freight containers used to transport pressurized materials such as, for example, pressure liquefied gases including chlorine, anhydrous ammonia, and fluorocarbons. Fluids such as these are shipped in tank containers with a maximum allowable working pressure between 100 and 500 psi. (The upper limit, 500 psi, is not a theoretical limit, but a regulatory one, and the applicant expects that if and when the pertinent regulations allow higher pressures, freight containers will be built to sustain such higher working pressures.)

Freight containers, including the freight container of the present invention, for the transport of pressurized materials such as pressure liquified gasses are intended to be mounted on a transport vehicle (such as a truck, boat, or railroad car), before or after being filled with a pressurized material, and then transported to a remote location. In most countries, freight containers must be approved for use by a competent authority (or its designated body) appointed by the specific country's government. For example, in the United States, these freight containers must be approved by the Department of Transportation (D.O.T.). Further in most countries the competent authority adopts in whole or in part, a recognized pressure vessel code. For example, the U.S. D.O.T. has adopted the American Society of Mechanical Engineers (ASME) Boiler and Pressure Vessel Code, with some additional limitations.

A freight container for a pressurized fluid, i.e., a tank container, includes a tank and a framework surrounding the tank. The tank includes various pipes and fittings which are designed to contain the cargo carried and to permit the tank to be filled and emptied. The tank may be formed from a cylindrical shell and two heads, one closing each end of the cylindrical shell. The dimensions of the shell include an outer radius $R_o$ and an inner radius $R_i$, the difference therebetween defining the shell's thickness $T_s$.

The shell and heads of a tank container are made of a material meeting the requirements of the approved pressure vessel code or approved by the competent authority. Typically in the United States the shell and heads of tank containers have been made from a high strength steel, SA612N, having an ultimate tensile strength ($S_u$) of at least 81,000 psi.

The framework of an ISO freight container for pressurized fluids includes tank mountings, end structures and other load-bearing elements which are not present for the purposes of containing the fluid. The framework functions to transmit static and dynamic forces arising out of the lifting, handling, securement, and transporting of the freight container as a whole. The framework includes eight corner fittings (four top corner fittings and four bottom corner fittings), rails, posts, and braces which form its base structure, its end structure and its side structure and satisfy the requirements of ISO 1496-3 Sections 5.1–5.5. In the context of the present application, the term "ISO frame" means a framework which satisfies the framework requirements of these sections.

An ISO freight container for pressurized fluid may also include certain additional components depending on the intended use of the container. For example, if the pressurized fluid is temperature sensitive and/or if the transportation will occur in a temperature extreme environment (i.e., hot or cold ambient temperatures), the freight container may include sunscreens, linings, jacketing (cladding), insulations, air baffles, etc.

In the past, the tanks of such freight containers for fluid under pressure have been designed and constructed in accordance with a recognized pressure vessel code, which in the United States is Section VIII, Division 1, of the ASME Boiler and Pressure Vessel Code covering unfired pressure vessels. The entire disclosure of this Division is hereby incorporated by reference. When these tanks are used at normal environmental conditions of temperature and pressure to hold and transport fluids, the minimum thickness $T_s$ of the shell has been determined by the following equation:

$$T_s \geqq (P\,R)/(E\,S_{DIV.\,1} - 0.6\,P)$$

where

P=the internal design pressure for the tank;

R=inside radius of tank's shell;

$S_{DIV.\,1}$=maximum allowable stress=$S_u/4$;

$S_u$=ultimate tensile strength; and

E=joint efficiency.

The joint efficiency, E, has a value of between 0 and 1, depending on the extent of radiography of the welded joints. When all welded joints are fully X-rayed, E has a value of 1 and essentially drops out of the equation. (In Division 2, all welded joints are required to be fully X-rayed, so this factor does not appear in the equation, which is given below.)

These prior art freight containers have satisfied the competent authorities in various countries concerned with approval of freight containers, including the United States Department of Transportation which is commonly viewed in the industry as having the most stringent approval requirements. Again it is noteworthy that the ASME Boiler and Pressure Vessel Code is not a permanent, standard and is subject to change from time to time. It is anticipated that the maximum allowable stress for Division 1 will be increased from its present value of $S_u/4$ to $S_u/3.5$. This would allow the shell to be proportionately thinner, and freight containers will be built to this specification when the change becomes effective.

Tank containers made according to Division 1 of the ASME Boiler and Pressure Vessel Code, Section VIII, which have a capacity of about 4500 U.S.W.G. (U.S. water gallons)

and a design pressure of between 335 and 400 psi have had a tare weight of between about 17,000 lbs and 20,000 lbs. This means that when filled to capacity and placed on a truck for transport over a highway, the tank container can easily cause the truck to exceed the weight limits established for such roads. Perhaps the most restrictive country in this regard is Japan, where a tank container should not exceed 53,000 lbs. when loaded. As a result of such load limits, many tank containers can be filled only partially, depending on the density of the fluid being shipped, and this can make them inefficient.

The present invention provides a novel ISO freight container having a tank design which results in a decrease in the freight container's tare weight. In a preferred embodiment, the present invention provides a freight container for transporting a fluid at a pressure P, typically between 100 psi and 500 psi. The freight container includes a tank and an ISO frame. The tank is made with a shell and heads that have an ultimate tensile strength ($S_u$) of 81,000 psi. The shell of the cylindrical vessel has a thickness $T_s$ given by:

$$T_s \leq (P\,R)/(E\,S_{DIV.\,1} - 0.6\,P)$$

where

P=the internal design pressure for the tank;

R=inside radius of tank's shell;

$S_{DIV.\,1}$=maximum allowable stress=$S_u/4$;

$S_u$=ultimate tensile strength; and

E=joint efficiency;

and substantially equal to $$T_s = (P\,R)/(S_{DIV.\,2} - 0.5\,P)$$

where

P=the internal design pressure for the tank;

R=inside radius of tank's shell;

$S_{DIV.\,2}$=design stress intensity=$S_u/3$ $S_u$=ultimate tensile strength.

The shell is manufactured to the above thickness with a typical manufacturing tolerance of ±6%.

Freight containers according to the present invention have satisfied the requirements of The United States Department of Transportation. Thus, a freight container according to the present invention may be mounted on a transport vehicle (such as a truck or railroad car), before or after being filled with a pressurized fluid, and then transported to a remote location. Freight containers according to the present invention have a tare weight approximately 2000 lbs less than comparable prior art freight containers where both have a capacity of about 4500 U.S.W.G. and a design pressure of 335 to 365 psi.

The present invention provides these and other features hereinafter fully described and particularly pointed out in the claims, the following description and annexed drawings setting forth in detail an illustrative embodiment of the invention, this being indicative, however, of but one of the various ways in which the principles of the invention may be employed.

DETAILED DESCRIPTION OF THE INVENTION

Figure 1:
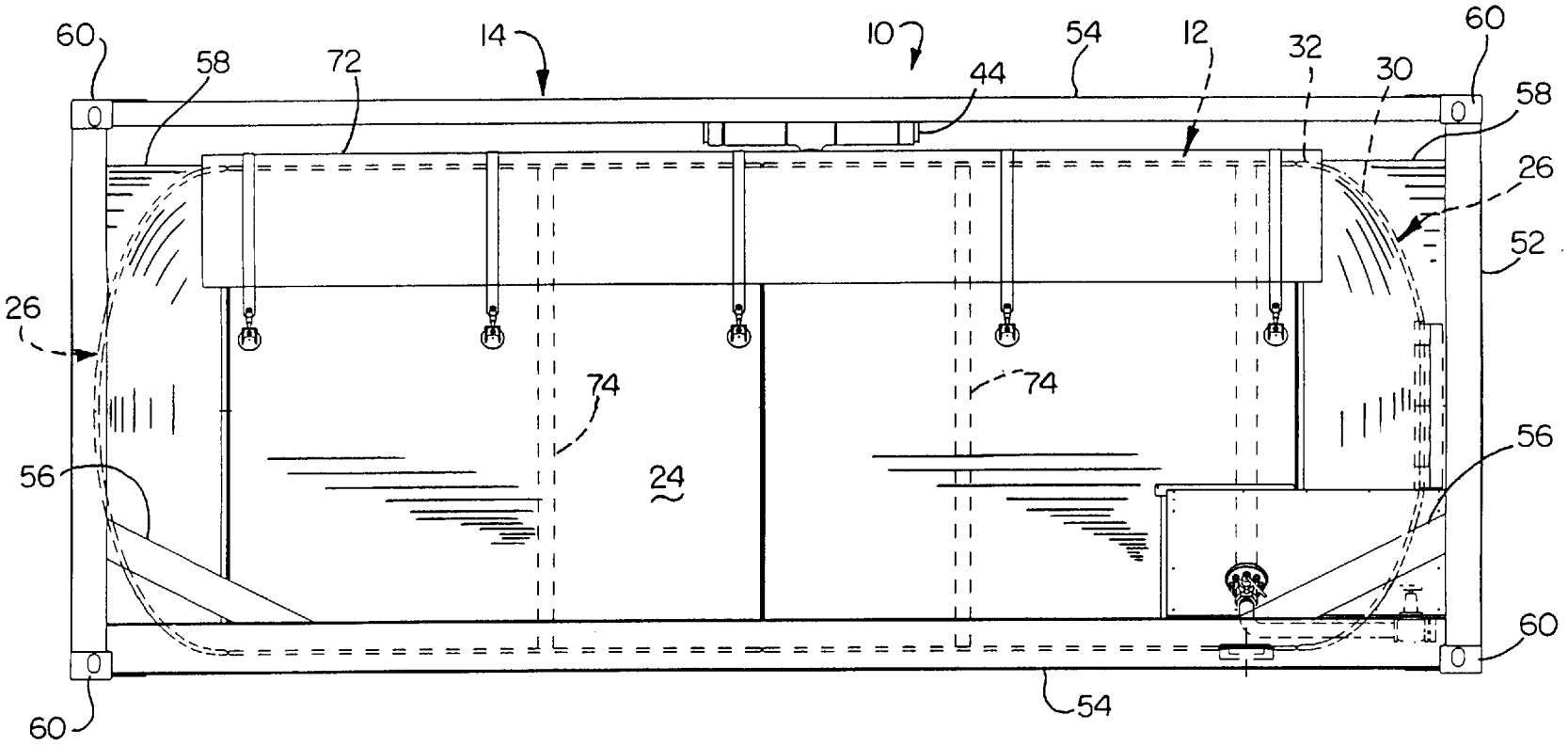
FIG. 1 is a side view of a freight container according to the present invention.
Figure 2:
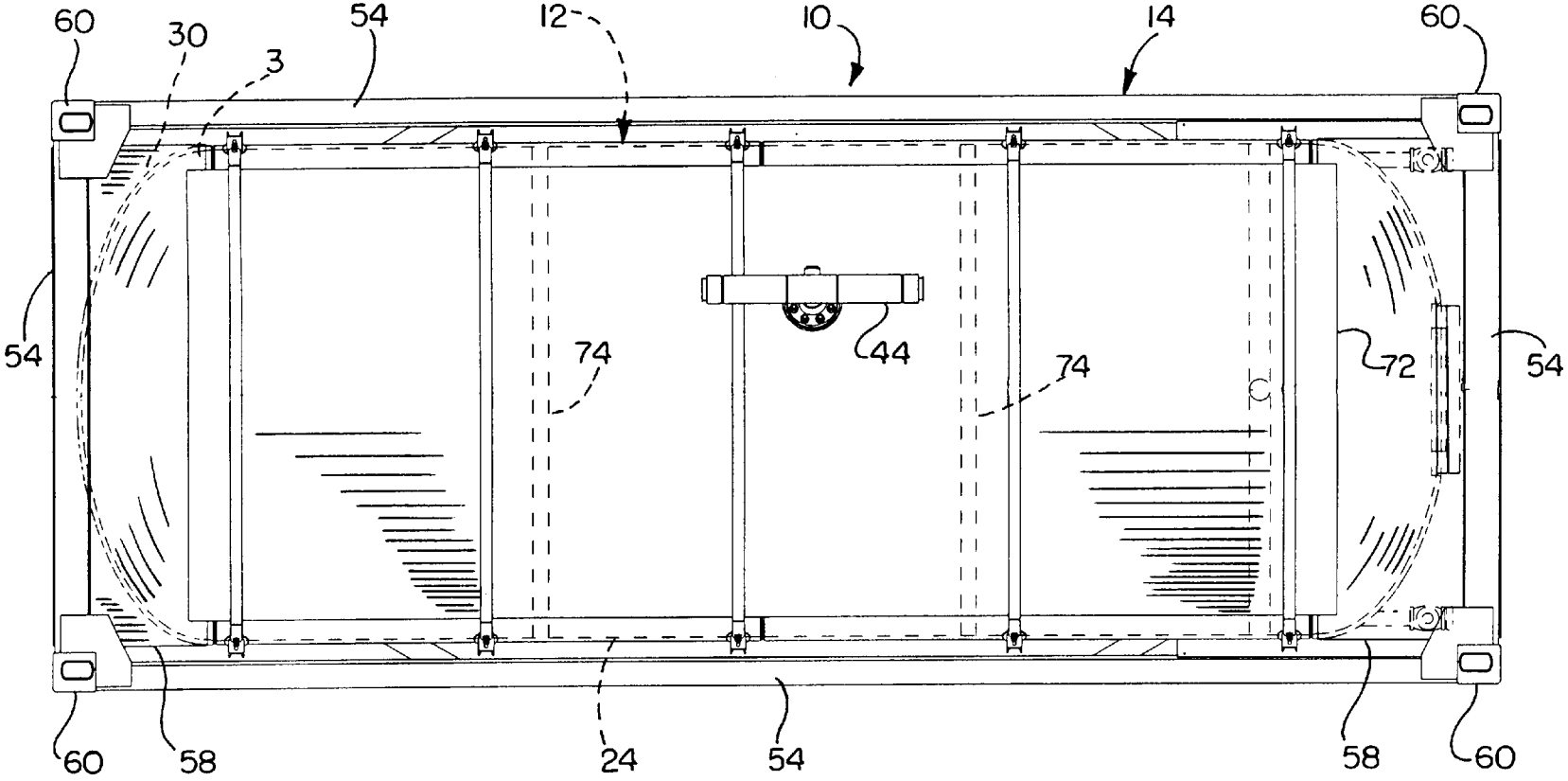
FIG. 2 is a top view of the freight container of FIG. 1.
Figure 3:
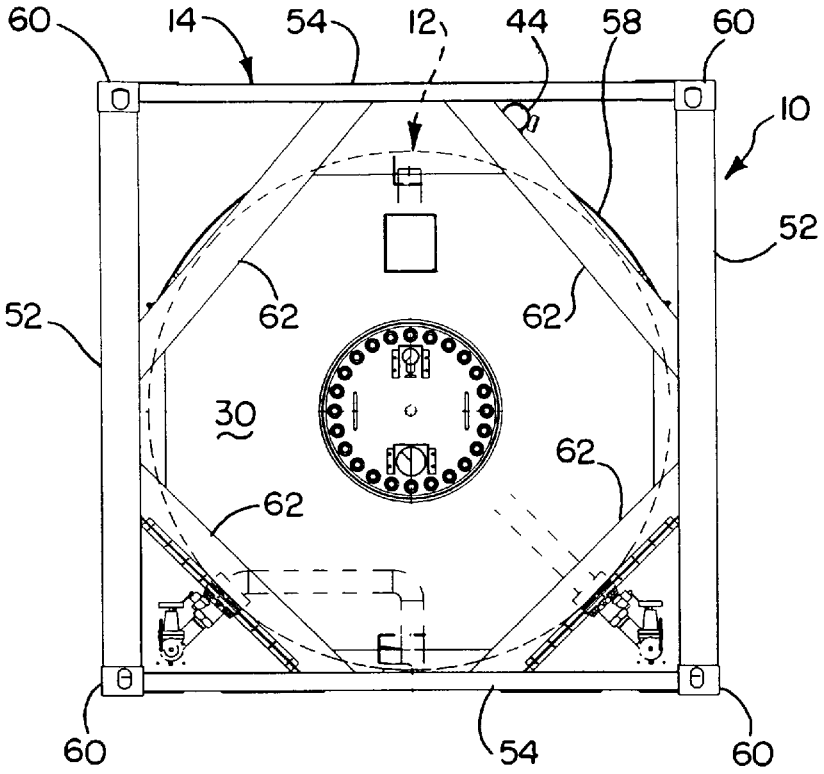
FIG. 3 is an end view of the freight container of FIG. 1.

A freight container 10 for transporting pressurized fluids having a service (or design) pressure P of at least 100 psi and not over 500 psi (limited by current regulations) is shown in FIGS. 1–3. As is explained in more detail below, the freight container 10 has a novel tank design which results in a decrease in the container's tare weight when compared to prior art freight containers.

The freight container 10 includes a tank 12 and a frame 14. The tank 12 includes a cylindrical shell 24 and two heads 26 on opposite ends of the cylindrical shell. The dimensions of the shell 24 include an outer radius $R_o$ and inner radius $R_i$, the difference therebetween defining the shell's thickness $T_s$.

The heads 26 each include an elliptical end portion 30 and a straight flange 32 extending from the outer circumference of the end portion 32 to the respective axial end of the cylindrical shell 24. The heads 26 are welded to the shell 24. Both the shell 24 and the heads 26 are made of a high strength steel, SA612N, a steel which, for the thicknesses involved, has an ultimate tensile strength $S_u$ of about 81,000 psi.

The frame 14 functions to transmit static and dynamic forces arising out of the lifting, handling, securement, and transporting of the freight container as a whole. The frame 14 includes posts 52, rails 54, braces 56, skirt support members 58 and other load-bearing elements which are not present for the purposes of containing cargo. These components of the frame 14 are joined at eight corner fittings 60 to form its base structure, its end structure and its side structure. The frame 12 may fully or only partially satisfy the requirements of ISO 1496-3 Sections 5.1–5.5. Other frame structures which satisfy the requirements of ISO 1496-3 Sections 5.1–5.5 are possible with, and are contemplated by, the present invention.

The skirt support members 58 provide connections between the frame 14 and the tank 12. The skirt support members 58 are cylindrical extensions of the shell 24. The skirt support members are welded to the braces 62 (FIG. 3) which extend between the posts 52 and the rails 54 of each end of the freight container 10.

The freight container 10 may also include certain additional components, such as a sun screen 72 (FIGS. 1 and 2) if necessary in view of the pressurized fluid being temperature sensitive and/or if the transportation will occur in an environment of temperature extremes. The freight container 10 may also include internal baffles 74 to limit surging when the vehicle carrying the freight container stops or starts.

The tank 12 is manufactured in accordance with Section VIII Division 2 of the ASME Boiler and Pressure Vessel Code covering unfired pressure vessels. The entire disclosure is this Division is hereby incorporated by reference. Specifically, the minimum thickness $T_s$ of the shell 24 is substantially:

$$T_s = (P\,R)/(S_{DIV.\,2} - 0.5\,P)$$

where

P=the internal design pressure for the tank;

R=inside radius of tank's shell;

$S_{DIV.\,2}$=design stress intensity=$S_u/3$; and $S_u$=ultimate tensile strength.

Calculations were performed in accordance with the requirements of Section VIII, Division 2 of the ASME Code to determine the minimum thickness for the shell at three different design pressures (335, 400, and 455 psig) and two different design stress intensities (23,300 psi and 25,000 psi). The pressures selected represent three different common design pressures for freight containers for fluids under pressure, and the two design stress intensities represent two different materials, one with an ultimate strength of about 69,900 psi and one with an ultimate strength of 75,000 psi.

Further Section VIII, Division 2 of the ASME Code, section AD-204.3 includes information on calculating the required thickness for the heads $T_h$, which were assumed to be 2:1 elliptical heads. The table below shows the results of these calculations.

| P (psig) | $R_i$ (in) | $S_m$ (psi) | $T_s$ (in) | $T_h$ (in) | Tare Weight (lbs) |
|---|---|---|---|---|---|
| 335 | 41.400 | 23,300 | 0.600 | 0.671 | 14902.42 |
| 335 | 41.44 | 25,000 | 0.559 | 0.656 | 14419.35 |
| 400 | 41.285 | 23,300 | 0.715 | 0.892 | 17183.87 |
| 400 | 41.33 | 25,000 | 0.667 | 0.818 | 16313.52 |
| 455 | 41.19 | 23,300 | 0.812 | 0.964 | 18581.58 |
| 455 | 41.25 | 25,000 | 0.757 | 0.890 | 17633.98 |

By way of comparison, the weight of the shell of the tank 12 is reduced by 25% and the weight of the heads by 6% from that of otherwise identical tanks made according to Division 1, Section VIII of the ASME Code. For example, a prior art tank container, Columbiana Boiler Co. Model B450, with a design pressure of 350 psi and made in accordance with Division 1, has a tare weight of 17,680 lbs. A tank container otherwise identical but constructed in accordance with the present invention, Columbiana Boiler Co., Model B450 LWGT, has a tare weight of 15,550 lbs. The difference between these two, 2130 lbs., represents the additional load which can be carried without exceeding highway load limits when the tank container is placed on a truck for transport.

When using the preferred material, SA612N, the calculation's results were as follows:

| P (psig) | $R_i$ (in) | $S_m$ (psi) | $T_s$ (in) | $T_h$ (in) | Tare Weight (lbs) |
|---|---|---|---|---|---|
| 335 | 40.55 | 27,000 | 0.500 | 0.6188 | 15,000 |
| 365 | 40.01 | 27,000 | 0.544 | 0.6667 | 15,750 |

A comparable tank containers manufactured according to Division 1 have tare weights of 17,200 lbs. and 18,300 lbs., respectively. The 2,200 lb. and 2,550 lb. differences in tare weight represent increased payload for a tank container having the same gross weight of container and payload.

In addition to the above calculations, a stress analysis of the head to shell junction where the straight flange 32 meets the shell 24 was performed in accordance with Mandatory Appendix 4, Section VIII, Division 2 of the ASME Code. The internal pressure, assumed to be 450 psig, was the only loading on the tank. Using the shell thicknesses and head thicknesses derived above, the calculations showed that the stress intensity at critical locations, namely the knuckle (where the elliptical end 30 meets the straight flange 32 of the head) and the head to shell junction, were below the maximum allowable stress intensity.

Figure 4:
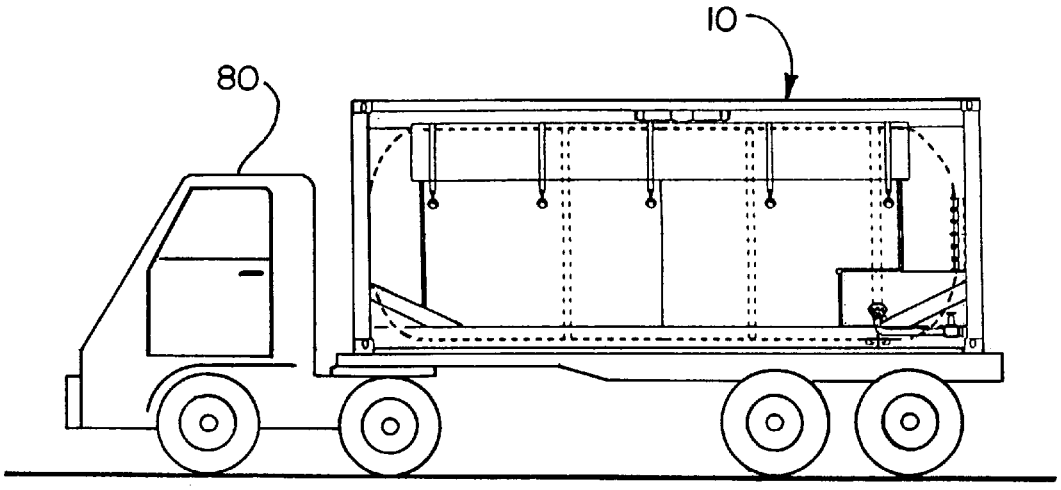
FIG. 4 is a schematic view of the freight container of FIG. 1 mounted on a transport vehicle.

A Finite Element Analysis (FEA) model of the tank container 10 with a fully ISO compliant frame 14 was carried out using COSMOS/M Finite Element Software with the applied design loading specified in accordance with the requirements of the U.S. D.O.T. 51 Specification. This analysis concluded that it appears that a freight container 10 manufactured in accordance with the present invention having a tank 12 designed in accordance with the requirements of Section VIII, Div. 2 of the ASME Code, is adequate to sustain the design loadings specified in the U.S. D.O.T. 51 Specification. Thus, the freight container 10 according to the present invention may be mounted on a transport vehicle 80 as shown schematically in FIG. 4, before or after being filled with the pressurized fluid, and then transported to a remote location. Of course, the vehicle 80 is exemplary only, and as with any ISO freight container, other modes of transportation such as rail and boat are also contemplated.

One may now appreciate that the present invention provides a novel freight container with a tank design which results in a decrease in the freight container's tare weight. Although the invention has been shown with respect to certain preferred embodiment, equivalent and obvious alternations will occur to those skilled in the art upon the reading and understanding of this application. The present invention includes all such alterations and modifications and is limited only by the scope of the following claims.

What is claimed is:

1. A freight container for transporting a pressurized fluid at a design pressure P to a remote location, said freight container comprising frame means to transmit static and dynamic forces arising out of the lifting, handling, securement, and transporting of the freight container as a whole a tank mounted within the frame means, and devices permitting the transfer of the freight container from one mode of transport to another;

the tank being formed of a material having an ultimate tensile strength $S_u$;

the vessel having a cylindrical shell having an inside radius $R_i$ and a thickness $T_s$ the thickness $T_s$ being less than:

$$P\ R_i/((\tfrac{1}{4}S_u)-0.6\ P)$$

and substantially equal to:

$$P\ R_i/((\tfrac{1}{3}S_u)-0.5\ P).$$

2. A freight container as set forth in claim 1 wherein the frame means is an ISO frame.

3. A freight container as set forth in claim 2 wherein the vessel includes heads enclosing opposite ends of the cylindrical shell and wherein the thickness $T_h$ of each of the heads is greater than the thickness of the shell.

4. A freight container as set forth in claim 3 wherein the ultimate tensile strength $S_u$ is greater than 80,000 psi.

5. A freight container for transporting a pressurized fluid at a design pressure P to a remote location, said freight container comprising:

a frame which transmits static and dynamic forces arising out of the lifting, handling, securement, and transporting of the freight container as a whole;

devices which permit the transfer of the freight container from one mode of tranport to another; and a tank mounted to the frame, being formed of a material having an ultimate tensile strength $S_u$, and including a cylindrical shell having an inside radius $R_i$ and a thickness $T_s$ less than $P\ R_i/((\tfrac{1}{4}S_u)-0.6\ P)$ and substantially equal to $P\ R_i/((\tfrac{1}{3}S_u)-0.5\ P)$.

6. A freight container as set forth in claim 5 wherein the frame is an ISO frame.

7. A freight container as set forth in claim 5 wherein the ultimate tensile strength $S_u$ is greater than 80,000 psi.

8. A freight container as set forth in claim 6 wherein the ultimate tensile strength $S_u$ is greater than 80,000 psi.

9. A freight container as set forth in claim 5 wherein the design pressure P is not over 500 psi.

10. A freight container as set forth in claim 5 wherein the design pressure P is between 100 and 500 psi.

11. A freight container as set forth in claim 6 wherein the design pressure P is between 100 and 500 psi.

12. A freight container as set forth in claim 6 wherein the design pressure P is between 100 and 500 psi.

13. In combination, a transport vehicle and the freight container of claim 5 mounted to the transport vehicle for transportation to a remote location.

14. A method of transporting pressurized fluid at design pressure P, said method comprising the steps of:

providing a freight container of claim 5;

mounting the freight container on a transport vehicle;

filling the tank with the pressurized fluid; and transporting the filled freight container to a remote location.

15. A method as set forth in claim 14 further comprising the step of transferring the filled freight container from the transport vehicle after said transporting step.

16. A method as set forth 15 wherein said transferring step includes transferring the filled freight container to another transport vehicle.

* * * * *